United States Patent [19]

Desplats et al.

[11] Patent Number: 4,475,717

[45] Date of Patent: Oct. 9, 1984

[54] TRACTION APPARATUS ANCHORED BY MEANS OF A SECURING PIN

[75] Inventors: André Desplats, Boulogne Billancourt; Hans Klabunde, Mareil Marly, both of France

[73] Assignee: Societe dite: Tractel, S.A., France

[21] Appl. No.: 396,589

[22] Filed: Jul. 9, 1982

[30] Foreign Application Priority Data

Jul. 10, 1981 [FR] France ..... 81 13620

[51] Int. Cl.[3] ..... B66D 3/02

[52] U.S. Cl. ..... 254/264; 254/384; 74/491; 74/566

[58] Field of Search ..... 254/243-261, 254/264, 384; 123/198 E; 74/566, 491, 323, 606 R; 403/348, 350, 353, 166, 150, 154; 24/68 CD, 68 CT, 69 CT, 69 CD, 69 T; 220/4 E

[56] References Cited

U.S. PATENT DOCUMENTS

| | | | |
|---|---|---|---|
| 3,285,093 | 11/1966 | Sellmeyer | 74/566 |
| 3,485,478 | 12/1969 | Desplats | 254/264 X |
| 3,675,499 | 7/1972 | Marosy | 403/353 X |
| 3,897,693 | 8/1975 | Garman et al. | 74/491 |
| 4,195,534 | 4/1980 | Prince | 74/491 |
| 4,212,559 | 7/1980 | Persson | 403/348 |

*Primary Examiner*—John M. Jillions
*Assistant Examiner*—David Werner
*Attorney, Agent, or Firm*—William A. Drucker

[57] ABSTRACT

Each half-case of the apparatus comprises a main half-case of pressed steel sheet provided with two chimneys on which is mounted a reinforcement piece, also of pressed steel sheet, having openings corresponding to the chimneys. The main half-case and the reinforcement piece separately each receive an anti-corrosion coating. Two symmetrical half-cases are finally fitted together along a longitudinal plane.

2 Claims, 11 Drawing Figures

TRACTION APPARATUS ANCHORED BY MEANS OF A SECURING PIN

BACKGROUND OF THE INVENTION

The invention relates to traction apparatus acting on a cable through two self-clamping clamps with reverse alternating movements for warping in and out of the cable.

Apparatus of this kind, such as the one described in French Pat. No. 914 400 of Sept. 5, 1945, are generally anchored to a fixed point by means of a hook. This anchorage is efficient but space-consuming and it has appeared that a pin mounting offers practically the same results for a smaller space occupied, a reduced weight and a lower price. However, the securing pin must find in the case of the apparatus adequate contact surfaces; on the other hand, in the anchorage zone, the metal section must be compatible with the stresses undergone by the case of the apparatus, which stresses are increased by a large safety coefficient. This explains why most traction apparatus with an anchorage pin are cast and not made from pressed steel sheet.

In fact, a pressed steel sheet construction requires the creation of a sort of ribbed casing whose different components must be firmly assembled together. Now, the usual methods of assembly, welding or riveting, present in this case different drawbacks, in particular the multiplication of the corrosion points in zones inaccessible for painting or for another mode of protection.

The present invention provides then a traction apparatus with pin anchorage which is designed to avoid the above-mentioned disadvantages and which offers a great strength in operation in particular under a high load, while allowing easy construction thereof.

SUMMARY OF THE INVENTION

To this end, in accordance with the invention, the casing of the traction apparatus is formed from two identical half-cases assembled about a longitudinal axis, each half-case comprising a main half-case formed from pressed steel sheet in which are provided chimneys whose dimensions correspond to those of the securing pin and of the shaft of the crank of the apparatus and a reinforcement piece made from ribbed pressed steel sheet, mounted on the main half-case, which has openings corresponding in diameter and between shaft distance to the chimneys of the mainhalf-case and which cooperate therewith. Each main case, and the reinforcement piece which is associated therewith, comprises and anticorrosion coating.

Advantageously, the securing pin intended for engagement in the facing chimneys provided at the front end of the casing of the traction apparatus in accordance with the invention is designed so as not to present the disadvantages of traditional securing pins with fixing by screwing or by means of a keeper pin.

To this end, the pin has a cylindrical body with at one end an operating head and which comprises at its opposite end a notch which locks by rotation on a projecting retention part integral with the cap for receiving the pin so as to prevent the axial movement thereof, a return spring acting on the pin, in the locked position thereof, to prevent rotation thereof.

Diametrically opposite the locking notch, the end of the pin has a flat portion of a depth slightly greater than the height of the projecting retention part of the cap so that the flat portion bears on the projecting part during positioning of the pin, before rotation of the pin through about 180° ensures locking thereof.

Moreover, since in the traction apparatus of the invention the warping control lever is generally placed in the axis of the apparatus, i.e. between the two half-cases, this arrangement involves the creation of an opening allowing a range of movement for this lever and, through this opening, the introduction of foreign bodies may be feared which may disturb the operation of the apparatus.

To palliate this disadvantage, the traction apparatus of the invention is advantageously provided with a protection device which closes almost completely the opening in the case while allowing free movement of the operating lever. The protection device is in the form of a flexible material part, having dimensions adapted to close off the gap between the two half-cases of the apparatus, which has at one end a means for hooking on to a fixed shaft and at its other end a means for fixing to another fixed shaft while providing a possibility of longitudinal movement of the flexible part with respect to this other fixed shaft. In particular, this possibility of longitudinal movement is permitted by giving a buttonhole shape to said other end of the flexible protection member. Over its length, the protection member has a slit for passing therethrough the cable which extends through the apparatus, as well as an opening for passing therethrough the control lever for warping out.

BRIEF DESCRIPTION OF THE DRAWINGS

To better understand the invention, preferred embodiments are described hereafter, with reference to the accompanying schematical drawings in which.

DESCRIPTION OF THE PREFERRED EMBODIMENTS

Figure 1:
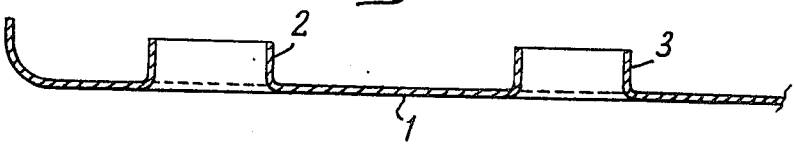
FIG. 1 is a longitudinal sectional view of the front of a main half-case used for the construction of the casing of a traction apparatus in accordance with the invention.

In FIG. 1 there has been shown the front part of a main half-case 1 made from pressed steel sheet and having inwardly a chimney 2, for receiving one end of the anchoring pin of the traction apparatus of the invention, and another chimney 3 for receiving one end of the pivoting shaft of the warping crank or lever of the apparatus. This main half-case receives a protection against corrosion, for example by coating with zinc.

Figure 2:
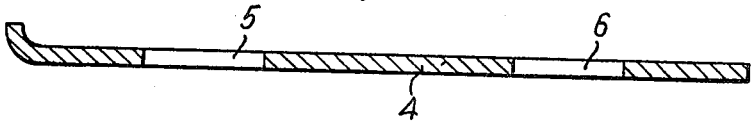
FIG. 2 is a longitudinal sectional view of a reinforcement piece.

The reinforcement part 4 shown in FIG. 2, made from metal sheet of adequate thickness and suitably ribbed, is also pressed out with holes 5,6 corresponding to the between shaft distance and the diameter of chimneys 2,3 of the main half-case. This reinforcement part 4 is also treated against corrosion.

Figure 3:
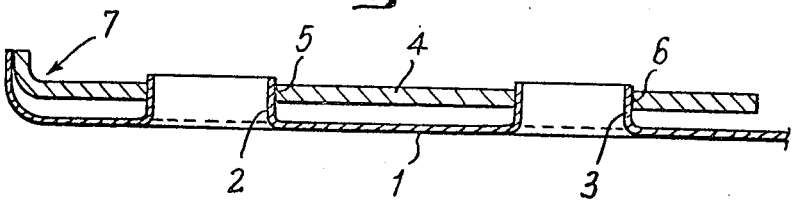
FIG. 3 is a longitudinal sectional view of the front part of a composite half-case.

As is shown in FIG. 3, the reinforcement part 4 is then mounted on the main half-case, to form a composite half-case 7, then the chimneys 2,3 are roller formed by means of tooling comprising, in addition to the roller forming tool, means for stopping the extension of the rollers so as to obtain bores having precise dimensions which correspond respectively to the securing pin and the shaft of the crank.

Figure 4:
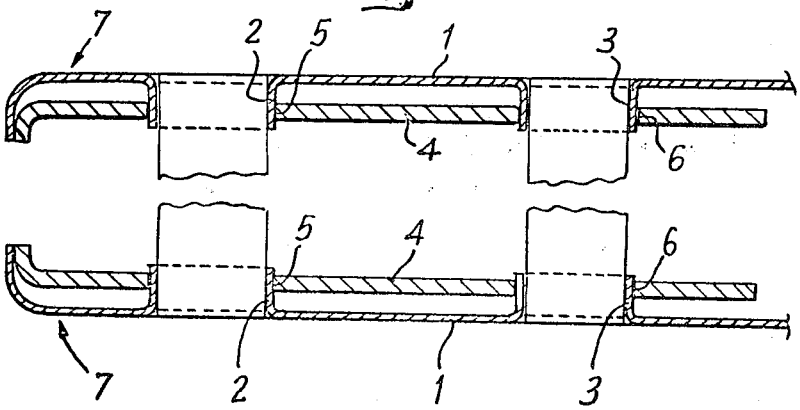
FIG. 4 is a longitudinal sectional view of the assembly of two identical composite half-cases.

Finally, as is shown schematically in FIG. 4, two identical composite half-cases 7 are assembled about a longitudinal axis of symmetry to protect the mechanism (not shown) of the traction apparatus.

Figure 5:
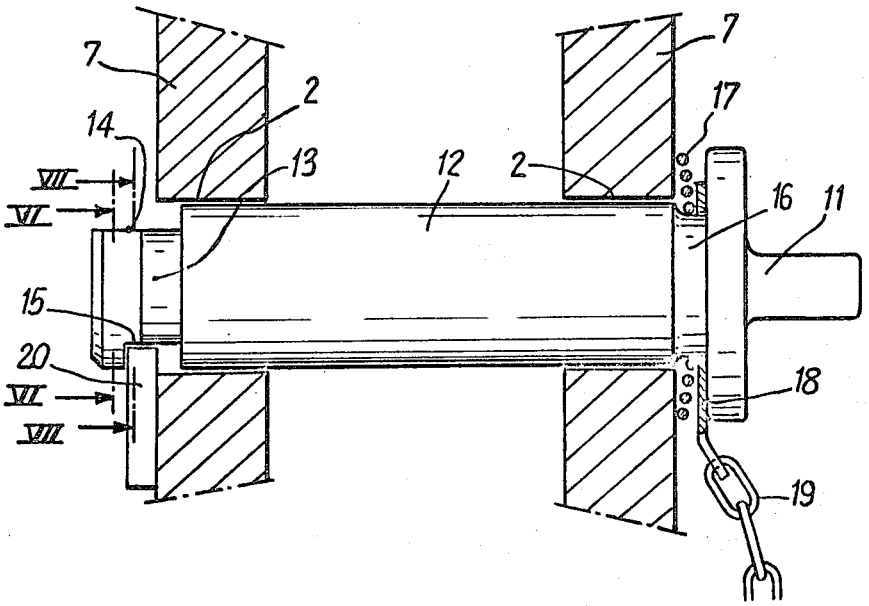
FIG. 5 is a profile view of a securing pin in position in its housing provided in the case of the traction apparatus of the invention.
Figure 6:
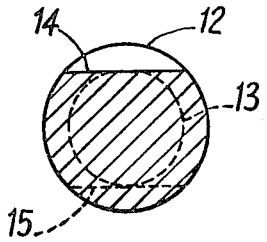
FIG. 6 is a vertical sectional view taken along line VI—VI of FIG. 5.
Figure 7:
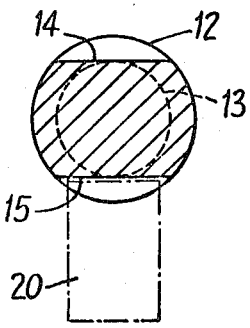
FIG. 7 is a vertical sectional view taken along line VII—VII of FIG. 5.
Figure 9:
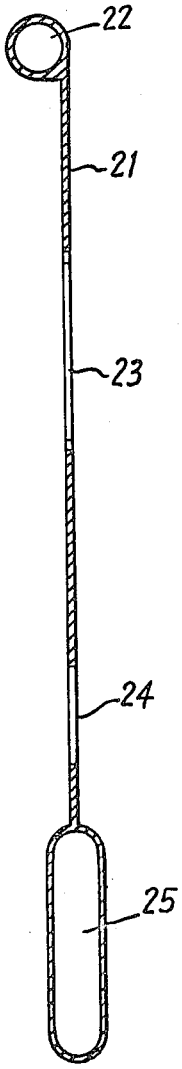
FIG. 9 is a section taken aong line IX—IX of FIG. 8.
Figure 8:
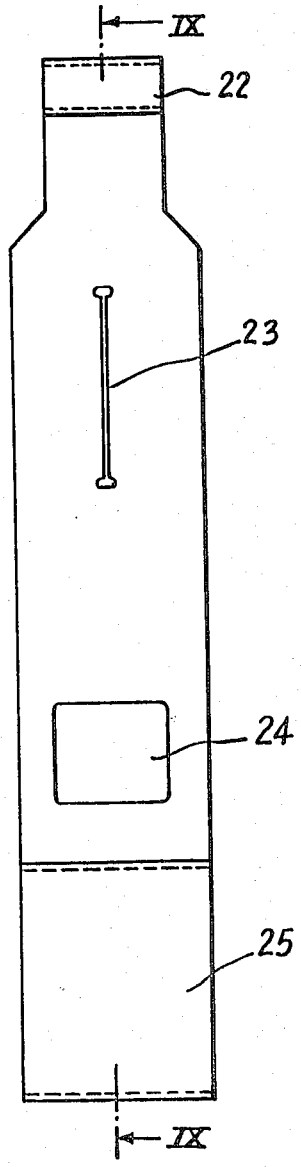
FIG. 8 is a top view of a protection device capable of being adapted to the casing of the traction apparatus of the invention.

In FIGS. 5 to 7, there has been more particularly shown a securing pin intended to be positioned in the openings of the case formed by chimneys 2.

The pin is made in one piece and comprises at its right-hand end, looking at FIG. 5, a head 11 having a shape for being readily gripped in the hand. The body 12 of the pin, cylindrical in shape, comprises towards its left-hand end, looking at FIG. 5, a concentric circular groove 13. A flat portion 14 extends from the end of the pin as far as groove 13 into which it runs at the level of the bottom thereof. Also at the level of the bottom of groove 13, but diametrically opposite with respect to flat portion 14, extends a milling 15 which does not this time go as far as the end of the pin.

The pin also comprises, under head 11, a groove 16 for receiving the last spiral turn of a spring 17, advantageously conical in shape, whose function is to urge body 12 of the pin towards the right in FIG. 5. Groove 16 also serves for housing a ring 18 for retaining a tie 19 for preventing loss of the pin. On the left-hand side, looking at FIG. 5, a small plate 20 is fixed to the outer face of case 7 of the apparatus while masking a portion of the hole formed by chimney 2 receiving the pin, the thickness of this plate being less than the width of groove 13 and the height of the projecting part of the plate being less than the depth of the groove 13.

The positioning of the pin will be explained hereafter. The user introduces the body 12 of the pin in hole 2 of case 7 on the side opposite plate 20, with the flat portion 14 at the end of the pin facing this plate. He then pushes the pin home, while comprising spring 17, by turning body 12 of the pin without discrimination either to the right or left. As soon as the pin is engaged on plate 20, the operator may cease pushing and simply turn the pin. When the milling 15 arrives in front of plate 20, spring 17 urges the pin slightly towards the right in FIG. 5 and this operation is accompanied by a click showing that the pin is correctly positioned. The pin is thus secured against rotation and it cannot be withdrawn by a translational movement towards the right neither.

For withdrawing the pin, the operator will have to carry out the opposite operations to those for introducing and positioning the pin, i.e. forcing the pin leftwards against the action of spring 17, rotating the pin to bring flat portion 14 in contact with plate 20, then withdrawing the pin by pulling rightwards.

With reference to FIGS. 8 to 11, a protection device has been shown for closing off the opening front end of the case 7 of the traction apparatus in accordance with the invention.

The protection device 21 is in the form of a part molded in a single piece from a flexible material, for example rubber. Part 21 has, starting from the top of FIGS. 8 and 9, a circular passage 22 serving as a fixing point, an opening 23 in the shape of a slit for passing therethrough the cable which passes through the traction apparatus to which the device is fixed, an opening 24 of appropriate shape for passing therethrough the operating lever of the apparatus and an oblong shaped passage 25 of the buttonhole kind providing a second fixing point.

Figure 10:
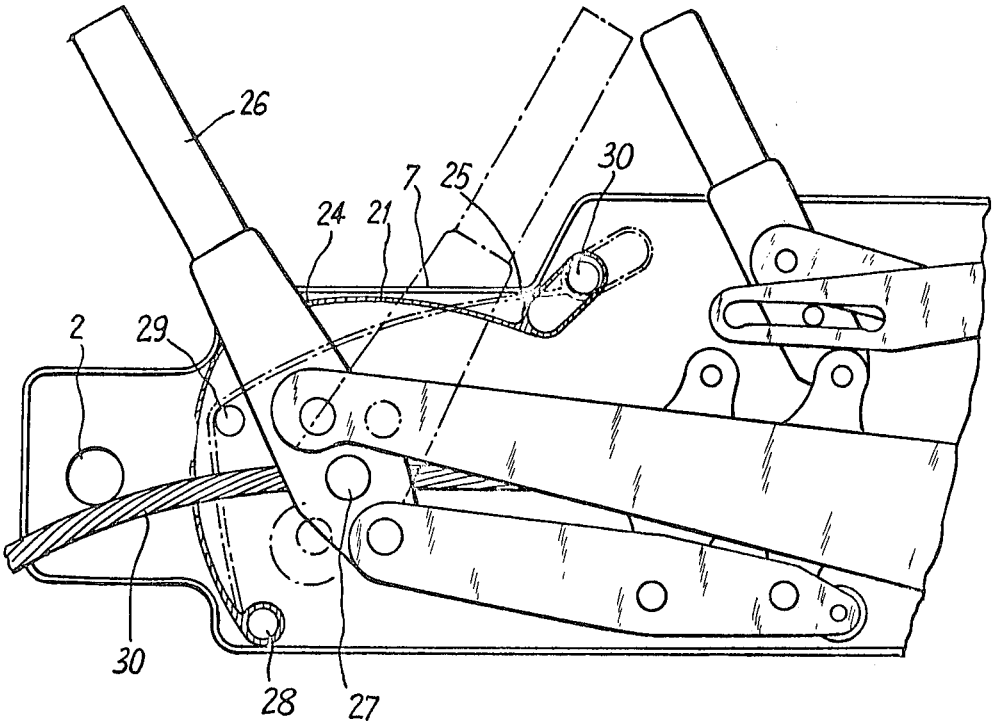
FIG. 10 is a side view, one of the half-cases having been removed, of the front part of the traction apparatus of the invention equipped with the protection device.
Figure 11:
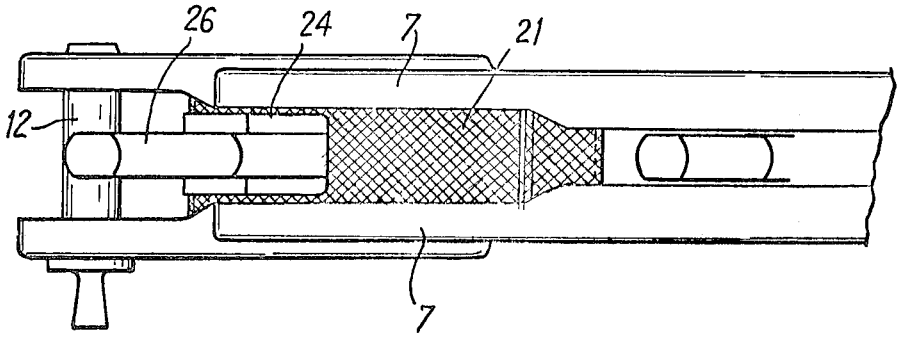
FIG. 11 is a top view corresponding to FIG. 10.

In FIGS. 10 and 11 there has been shown the front end of a traction apparatus comprising two half-cases 7 assembled about the mechanism of the apparatus and defining therebetween a free space for movement of the warping control lever 26 pivotably mounted on a transverse shaft 27 disposed in chimneys 3. The protection piece 21, which is of a width such that it fits snugly between the two half-cases 7, is positioned so as to close off the free space defined therebetween. To this end, passage 22 of part 21 is fixed to the lower cross piece 28 for assembling the half-cases 7, whereas the intermediate part of the body of part 21 is guided by another assembly cross piece 29 and the buttonhole 25 hooks on to the upper assembly cross piece 30. As can be seen in the drawings, the warping control lever 26 projects through opening 24 whereas cable 31 passes through slit 23. Thus disposed, part 21 efficiently protects the mechanism against the introduction of any foreign body.

In FIG. 10 there has been shown with a continuous line lever 26 and protection piece 21 in positions corresponding to the endmost position of rotation of lever 26 in one direction and, with a dash-dot line, the same elements in positions corresponding to an endmost position of rotation of lever 26 in the opposite direction. Thus can be seen the role played by button hole 25, which cooperates with the upper cross piece 30 for limiting the deformations of part 21 as well as the extension thereof.

It will be readily understood that the above description has been given solely by way of example without any limiting character, and that additions or constructional modifications could be made thereto without departing from the scope and spirit of the invention defined by the claims.

What is claimed is:

1. In a traction apparatus through which passes a cable and which presents anchoring means adapted to be attached to a fixed point when the apparatus is worked, a case containing the mechanism of the apparatus and which comprises:

(a) a first half-case made from pressed steel sheet, (b) a first chimney provided inwardly in said half-case for receiving one end of a transverse pin acting as anchoring means for the apparatus, (c) a second chimney provided inwardly in said first half-case and adapted to receive one end of a transverse pivoting shaft of a warping control lever of the apparatus, (d) a first reinforcement part made from pressed steel sheet and provided with holes which correspond in diameter and in between shaft distance with said first and second chimneys provided in said first half-case, so that by mounting said first reinforcement part on said first half-case is obtained a first half-case assembly of great rigidity, (e) a second half-case made from pressed steel sheet and symmetrical with respect to said first half-case, (f) a first chimney provided inwardly in said second half-case and adapted to receive the other end of the transverse pivoting shaft of the warping control lever, (g) a second chimney provided inwardly in said second half-case and adapted to receive the other end of the transverse pivoting shaft of the warping control lever, and (h) a second reinforcement part made from pressed steel sheet and symmetrical with respect to said first reinforcement part, whereby, by mounting said second reinforcement part on said second half-case, a second half-case assembly of great rigidity and symmetrical with relation to said first half-case assembly is provided, so that by assembling said first and second half-case assemblies about a longitudinal axis of symmetry, on said transverse pin and said transverse pivoting shaft, is obtained a case adapted to resist to high stresses imparted thereto through said anchoring means.

2. Traction apparatus according to claim 1 having in its front part an opening for the pivoting movement of said warping control lever, said opening resulting in a gap between the assembled half-case assemblies, wherein a protection element is provided for closing off said gap, said protection element being made from a flexible material, presenting openings for passing therethrough the warping control lever and the houing adapted to engage a fixed shaft and at its opposite end another housing shaped as a buttonhole and adapted to engage another fixed shaft, said housing shaped as a buttonhole allowing a limited longitudinal movement of the protection element when the warping control lever is operated.

* * * * *